US011417477B2

(12) United States Patent
Son et al.

(10) Patent No.: US 11,417,477 B2
(45) Date of Patent: Aug. 16, 2022

(54) ROTARY SWITCH

(71) Applicants: LG Electronics Inc., Seoul (KR); Younghwan Jun, Seoul (KR)

(72) Inventors: Jinhwan Son, Seoul (KR); Younghwan Jun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/564,625

(22) Filed: Sep. 9, 2019

(65) Prior Publication Data

US 2020/0090887 A1 Mar. 19, 2020

(30) Foreign Application Priority Data

Sep. 14, 2018 (KR) ..... 10-2018-0110426

(51) Int. Cl.
*H01H 19/14* (2006.01)
*H01H 19/04* (2006.01)
*H01H 19/56* (2006.01)

(52) U.S. Cl.
CPC ..... *H01H 19/14* (2013.01); *H01H 19/04* (2013.01); *H01H 19/56* (2013.01); *H01H 2215/03* (2013.01)

(58) Field of Classification Search
CPC ..... H01H 19/14; H01H 19/04; H01H 19/56; H01H 2215/03; H01H 19/58; H01H 19/11; H01H 19/08
USPC ..... 200/564, 569–571, 336
See application file for complete search history.

(56) References Cited

U.S. PATENT DOCUMENTS 5,669,489 A * 9/1997 von Ende ..... G01D 5/25 200/11 R
8,440,928 B2 * 5/2013 Hisamune ..... H01H 19/115 200/564
2009/0184848 A1 * 7/2009 Sugahara ..... H01H 19/20 341/11
2016/0209863 A1 7/2016 Stringos

FOREIGN PATENT DOCUMENTS

CN 201122548 Y 9/2008
JP 2011-009170 A 1/2011
JP 2011-119170 A 6/2011
JP 2012-113985 A 6/2012
JP 2013-004879 A 1/2013
(Continued)

OTHER PUBLICATIONS

Office Action received from the Korean Intellectual Property Office (KIPO) in Korean Patent Application No. 10-2018-0110426, dated Jun. 18, 2019.

(Continued)

*Primary Examiner* — Lheiren Mae A Caroc
(74) *Attorney, Agent, or Firm* — Birch, Stewart, Kolasch & Birch, LLP

(57) ABSTRACT

A rotary switch having a fixing body, a rotating body disposed in the fixing body, a cover coupled to an upper portion of the fixing body, and a first elastic body positioned under the cover to contact a plurality of protrusions formed on the rotating body is provided. The protrusions of the rotating body protrude in a side direction and radial direction of the rotating body to improve a rotational operation feeling and the quality of a rotational sound.

20 Claims, 14 Drawing Sheets

(56) References Cited

FOREIGN PATENT DOCUMENTS

| | | | |
|---|---|---|---|
| KR | 10-2005-0080122 | A | 8/2005 |
| KR | 10-0670540 | | 1/2007 |
| KR | 10-2008-0044464 | | 5/2008 |
| KR | 10-2014-0090072 | A | 7/2014 |

OTHER PUBLICATIONS

Notice of Allowance received from the Korean Intellectual Property Office (KIPO) in Korean Patent Application No. 10-2018-0110426, dated Oct. 15, 2019.
International Search Report received in PCT Application No. PCT/KR2019/011889, dated Sep. 11, 2019 (90 pages).
European Search Report received in European Application No. 19184341.6, dated Feb. 7, 2020 (38 pages).
Office Action in Korean Patent Application No. KR 10-2020-0005241, dated Nov. 4, 2021 (3 pages).

* cited by examiner

ROTARY SWITCH

CROSS-REFERENCE TO RELATED APPLICATIONS

The present application claims priority under 35 U.S.C. 119 and 35 U.S.C. 365 to Korean Patent Application No. 10-2018-0110426, filed on Sep. 14, 2018, the disclosure of which is hereby incorporated by reference in its entirety.

BACKGROUND

The present disclosure relates to a rotary switch.

A rotary switch may switch a contact and select a circuit through rotation operation. Accordingly, as the rotary switch performs an on/off control of an individual switch through the rotation operation, the configuration of the circuit may be varied.

The rotary switch may generate a pulse signal by rotating clockwise or counterclockwise. Accordingly, the rotary switch may be called a rotary encoder switch.

The rotary switch is provided in various products. For example, the rotary switch may be provided in a washing machine. In this case, the rotary switch may be used as a handling device of the washing machine. Accordingly, a user may select a desired operation mode of the washing machine by rotating the rotary switch.

In general, the rotary switch may comprise a handling unit configured to be rotated and operated by the user, a rotating body configured to rotate through the rotation of the handling unit, and a fixing body configured to allow the rotating body to be received therein and make sliding contact with the rotating body.

In addition, the fixing body may comprise a switch pattern connected with a terminal. In addition, the rotating body may comprise a metallic plate making sliding-contact with the switch pattern through the rotation. The on-off control of the switch may be performed through the sliding-contact between the metallic plate and the switch pattern.

A conventional rotary switch has the following problem.

First, a space is formed in the rotating body in the longitudinal and transverse directions, so the shaking and the vibration of the rotating body are relatively large during rotation.

Second, according to the conventional rotating body, a concavo-convex part formed at a circumferential surface thereof determines the rotational sound and torque necessary for the rotation. Accordingly, the rotational operation feeling, which allows the user to tactilely recognize the rotation, is coarse, and the user may feel that the rotational sound, which is dependent on the rotation of the operation part and allows the user to audibly recognize the rotation, is relatively blunt.

Third, it is difficult to finely adjust an allowable torque value allowing the rotation in the procedure of manufacturing the rotary switch. In other words, it is difficult to perform fine tuning for allowable torque for the rotation of the rotary switch.

Fourth, by the handling of the user, force applied in the shaft direction of the rotating body or drawing force outward direction may be applied to the rotary switch. In this case, the leaf spring and the rotating body may be easily deformed (or broken) by force applied in the shaft direction or drawing force outward.

Fifth, the roughness (or protrusion) may be cracked due to the repeated rotation of the rotating body, thereby reducing the lifespan of the product.

Sixth, since only the fixing body and the cover are coupled to receive the rotating body, the durability of the rotary switch may be relatively degraded.

Information on the prior art will be described as follows.

(Patent Document 1) KR10-2008-0044464 entitled "Control device of a laundry processing device."

(Patent Document 2) KR10-0670540 entitled B1 "rotary switch assembly."

SUMMARY

The present disclosure is suggested to solve the problem of the conventional rotary switch, and provides a rotary switch which may minimize a space separated from a rotating body.

The present disclosure provides a rotary switch which may minimize the clearance between components, which is caused due to rotation.

In addition, the present disclosure provides a rotary switch configured to improve the rotational operation feeling and a rotational sound.

In addition, the present disclosure provides the structure of a rotary switch configured to allow the design of relatively fine allowable torque for rotation.

In addition, the present disclosure provides a rotary switch configured to prevent the deformation and the breakdown even if drawing force is applied outward or force is applied in the shaft direction.

In addition, the present disclosure provides a rotary switch configured to minimize cracks which are caused due to the repeated rotation of a rotating body.

Further, the present disclosure provides the structure of a rotary switch in which the coupling between components is strong and stable.

In order to accomplish the objects, a rotary switch may comprise a fixing body, a rotating body disposed in the fixing body to rotate, a cover coupled to an upper portion of the fixing body and configured to allow the rotating body to pass through the cover, a first elastic body disposed under the cover to contact, while rotating, a first protrusion in the rotating body protruding in the shaft direction; and a second elastic body disposed under the cover to contact, while rotating, a second protrusion formed in the rotating body and protruding in the radial direction. Accordingly, the first elastic body and the second elastic body may improve the quality of the rotary switch in the rotational operation feeling and the rotational sound.

The first elastic unit may be configured to support the rotating body in the shaft direction. In addition, the second elastic unit may be configured to support the rotating body in the side direction. Accordingly, the rotation of the rotating body may be performed stably, and the generation of clearance between the components may be minimized.

The first elastic body may be ring-shaped. The second elastic body may be plate-shaped.

The first elastic body may include an elastic ring, and the second elastic body may include a leaf spring.

The rotating body may comprise one or more protrusions protruding in the shaft direction and one or more protrusions protruding in the radial direction. Accordingly, the rotary switch may be capable of functionally separating the rotational operation feeling and the rotational sound in the protrusion direction of the protrusion, which is different from conventional art. Therefore, the rotary switch according to the embodiment of the present disclosure may optimize the rotational operation feeling and the rotational sound in terms of sensibility of the user.

The elastic ring may contact the one or more protrusions protruding in the shaft direction of the rotating body, while rotating. According to the elastic ring pressing the rotating body in the shaft direction, the rotating body may minimize the space in the shaft direction (or vertical direction) as compared to the rotary switch.

In addition, the elastic ring may be interposed between the bottom surface of the cover and the base of the rotating body and may provide force to the rotating body. Accordingly, the rotation stability and the rotational operation feeling of the rotary switch may be improved.

Meanwhile, the rotating body may comprise a circular base and a shaft extending vertically from a center of the base. In addition, the protrusion formed in the rotating body may include a side protrusion protruding in a radial direction along the outer circumference surface of the base and an upward protrusion protruding perpendicularly to the side protrusion.

The upward protrusion may protrude upward from the rotating body and the side protrusion may protrude in the side direction of the rotating body.

The surfaces of the upward protrusion and the side protrusion, which may contact the elastic ring or the leaf spring, may be curved.

In addition, the leaf spring contacting the side protrusion while rotating may be provided under the elastic ring. The side protrusion contacting the leaf spring may instantly generate cheerful rotational sound.

In addition, the upward protrusion, which contacts the elastic ring in the vertical direction of the rotating body may provide a soft rotational operation feeling to the user.

In addition, the upward protrusion and the side protrusion may be formed in a semicircular shape to make stable rotational contact.

Further, the upward protrusion and the side protrusion may be formed with mutually different slopes due to the difference in durability between the leaf spring and the elastic ring.

In addition, to make smooth rotational contact with the elastic ring, a curved surface of the upward protrusion protruding from the base may have a smaller inclination angle than a curved surface of the side protrusion.

In addition, the upward protrusion and the side protrusion may be positioned perpendicularly to each other and corresponding to each other, thereby generating the rotational sound depending on the rotation of the rotary switch. For example, a diameter of the upward protrusion in the longitudinal sectional surface may be identical to the diameter of the side protrusion in the cross-sectional surface. In other words, the upward protrusion and the side protrusion may have the same starting point and end point for protruding from the base of the rotating body. Accordingly, the rotational sound may be generated corresponding to the rotational operation of the user.

In addition, the upward protrusion and the side protrusion may extend from a common point to be perpendicular to each other. Accordingly, the rotational sound may be generated corresponding to the rotation of the rotary switch.

Further, the upward protrusion may protrude from the base at a slope, which may be smaller than that of the side protrusion.

The upward protrusion and the side protrusion may have oval-shaped sectional surfaces. For example, the upward protrusion may have a radius that decreases from the central point (O) toward the highest point, and the side protrusion may have a radius that increases from the central point (O) toward the outermost point.

In addition, the upward protrusion may be formed such that a maximum extension length (V) of the upward protrusion may be shorter than a maximum extension length (R) of the side protrusion.

Further, a radius of the upward protrusion in the longitudinal sectional surface may be identical to the radius of the side protrusion in the cross-sectional surface.

Meanwhile, to provide elastic force to the upward protrusion, the elastic ring may comprise an elastic protrusion protruding downward.

At least two elastic protrusions may be provided.

In addition, a plurality of elastic protrusions may be positioned symmetrically to each other. Accordingly, the elastic ring may guide the stable rotation since the elastic ring presses the upward protrusion in at two points that may be symmetrical to each other.

Further, to provide a force directed toward the central axis of the rotating body, the elastic ring may be tapered at opposite sides thereof.

In other words, the elastic ring may comprise a first bending part bent and inclined downward at one side and a second bending part bent and inclined downward at an opposite side thereof.

Further, the first bending part and the second bending part may have the same inclination angle as the angle, at which the first bending part and the second bending part are bent from the center of the elastic ring.

In addition, the first bending part and the second bending part may be symmetrical to each other. Accordingly, the force acting on the rotating body from the elastic ring may face the center, so that stable rotation of the rotating body may be guided.

In addition, the elastic protrusion formed on the elastic ring may protrude downward from the first bending part and the second bending part, respectively. For example, the elastic protrusions may protrude perpendicularly to a bottom surface of each of the first bending part and the second bending part.

In addition, the elastic protrusions may be rounded downward.

Further, to enhance the elastic force of the elastic protrusion, the elastic ring may have elastic enhancing holes formed at opposite sides of the elastic protrusion. The elastic enhancing holes may include openings to space the elastic protrusion from the bending parts (e.g., the first bending part and the second bending part).

In addition, the elastic ring may be provided in the type of a ring to contact the upward protrusion under the ring. Accordingly, the clearance, which may occur in the vertical direction (or shaft direction), may be minimized.

In addition, the upward protrusion of the rotating body contacting the elastic ring may be designed to have allowable torque values (unit kgf·cm) in the 10 or 100 units such that the fine tuning of the allowable torque is possible in the procedure of manufacturing the rotary switch. The side protrusion of the rotating body contacting the leaf spring may be designed to have an allowable torque value of 1 unit (unit kgf·cm) or less.

To minimize the acting of force applied in the side direction or drawing force in an outward direction with respect to the elastic ring and the leaf spring, the support plate of the bracket may be inclined upward, and the support groove of the fixing body may be recessed to correspond to the support plate.

In addition, to minimize the force applied to the elastic ring in the side direction or the drawing force applied in an outward direction to the elastic ring, a shaft stopper having a step difference along the lower circumference of the shaft of the rotating body may contact the bottom surface of the cover.

In addition, to minimize the cracks of the elastic ring or the upward protrusion which is caused due to the repeated rotation, the extending rib extending in the radial direction from the shaft stopper to the upward protrusion may be provided.

The extending rib may stably guide the contact between the elastic ring and the upward protrusion.

In addition, to strongly couple the bracket to the fixing body, the fixing body may comprise a coupling boss protruding from the outer circumferential surface of the fixing body.

The coupling boss may be inserted into a boss hole formed in the connection plate of the bracket.

In addition, for stable fixation of the bracket, the cover, and the fixing body, the fixing body may comprise a coupling shaft extending upward. The coupling shaft may be positioned so as to sequentially pass through the coupling hole in the cover and the insertion hole in the bracket. In other words, the coupling shaft may perform a function of guiding the coupling of the cover and the bracket.

Further, the rim of the cover and the fixing body may form steps corresponding to each other. In detail, an inner wall extending vertically upward may be provided on the upper end portion of the fixing body to form the step and an outer wall extending vertically downward from the outer circumference may be formed at the lower end portion of the cover to form the step. In addition, the outer wall and the inner wall may be coupled to each other to be in close contact with each other.

In addition, the bracket may be positioned on the cover such that the rotating body may pass through the bracket. In addition, the bracket may be coupled to the cover and the fixing body. Accordingly, the stable coupling and support between components may be maintained, so that the rotation stability of the rotary switch may be improved.

According to the present disclosure, the protrusions of the rotating body and the elastic ring, which are separated from each other functionally and structurally, may be provided to minimize the space separated apart from the rotating body and the clearance between components, thereby reducing the shaking and the vibration. In addition, the rotation stability of the rotary switch may be improved.

According to the present disclosure, when the user rotates and manipulates the handling unit, elastic force may be applied to the side protrusion and the upward protrusion of the rotating body, thereby minimizing the vibration. Accordingly, a relatively smooth rotational operation feeling may be provided. In addition, a more cheerful rotational sound may be provided. Accordingly, the product may be higher in quality in terms of sensibility.

According to the present disclosure, the fine tuning of the allowable torque may be possible when manufacturing the rotary switch, which is different from the conventional rotary switch. In addition, high-quality rotational operation feeling may be provided. Therefore, the reliability of the product may be improved.

According to the present disclosure, the support plate of the bracket may be bent, and the support groove of the fixing body may be recessed to correspond to the support plate. Accordingly, the rotary switch may be prevented from being broken or deformed by the force applied to the rotary switch in the shaft direction or the drawing force applied in an outward direction from the rotary switch. In other words, the durability of the product may be improved, so the lifespan of the product may be improved.

According to the present disclosure, the extending rib extending to the upward protrusion may guide the rotational contact between the elastic ring and the upward protrusion due to the rotation of the rotating body, and the stiffness of the upward protrusion may be reinforced. Accordingly, the cracks of the elastic ring or the upward protrusion may be minimized. Accordingly, the lifespan of the product may be extended.

In addition, since the fixing body, the cover, and the bracket may be mutually strongly coupled and supported, the durability of the rotary switch may be improved.

In addition, since the outer wall and the inner wall may be coupled to contact each other, the fixing body and the cover may be stably maintained airtight and sealed.

DETAILED DESCRIPTION OF THE EMBODIMENTS

Figure 1:
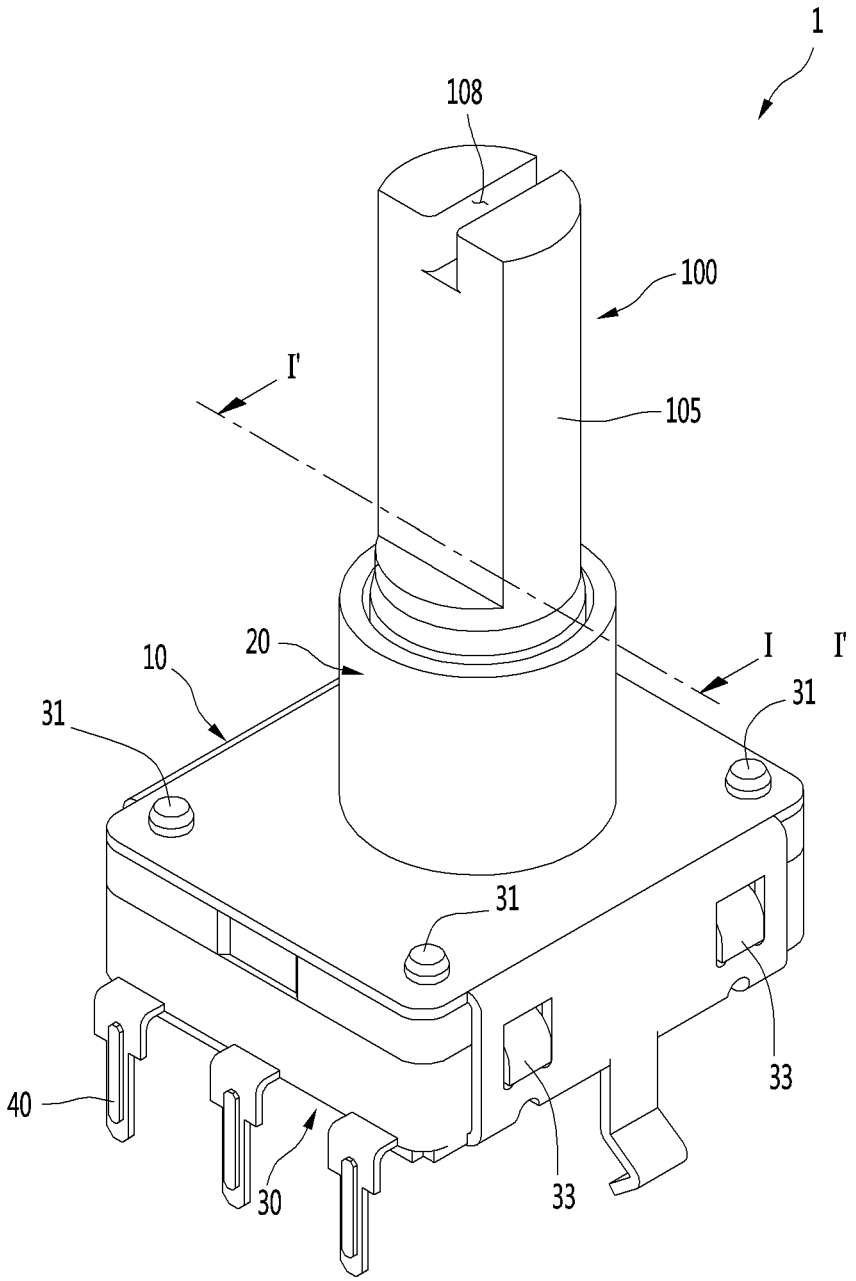
FIG. 1 is a perspective view illustrating a rotary switch according to an embodiment of the present disclosure.

Hereinafter, some embodiments of the present disclosure will be described in detail with reference to accompanying drawings. In adding the reference numerals to the components of each drawing, it should be noted that the identical or equivalent component is designated by the identical numeral even when they are displayed on other drawings. In addition, in the following description of an embodiment of the present disclosure, a detailed description of well-known features or functions will be ruled out in order not to unnecessarily obscure the gist of the present disclosure.

In the following description of elements according to an embodiment of the present disclosure, the terms 'first', 'second', 'A', 'B', '(a)', and '(b)' may be used. These terms are merely intended to distinguish one component from another component, and the terms do not limit the nature, sequence or order of the constituent components. When a certain element is "liked to", "coupled to", or "connected with" another element, the certain element may be directly linked to or connected to another element, and a third element may be "linked", "coupled", or "connected" between the certain element and another element.

Figure 2:
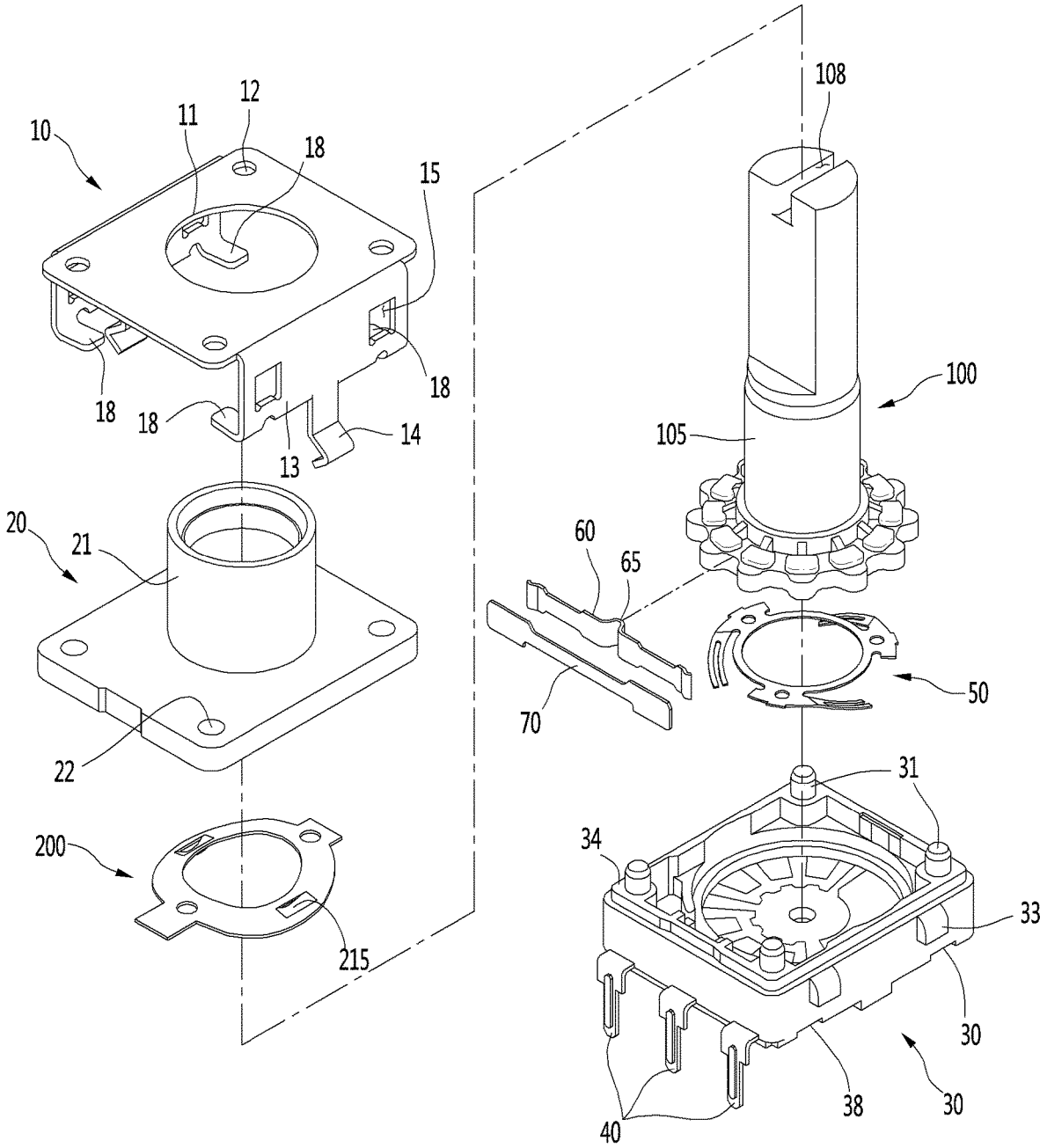
FIG. 2 is an exploded perspective view illustrating the configuration of the rotary switch of FIG. 1 according to an embodiment of the present disclosure.

FIG. 1 is a perspective view illustrating a rotary switch according to an embodiment of the present disclosure, and FIG. 2 is an exploded perspective view illustrating the configuration of the rotary switch of FIG. 1 according to an embodiment of the present disclosure.

Referring to FIGS. 1 and 2, a rotary switch 1 according to an embodiment of the present disclosure may comprise a bracket 10.

The bracket 10 may be stably engaged with other components positioned under the bracket 10. For example, a cover 20 and a fixing body 30 positioned under the bracket 10 may be firmly engaged with the bracket 10.

In detail, the bracket 10 may be formed in the center thereof with a central opening 11 open to allow a shaft 105 of the rotating body 100 to pass through the central opening 11. For example, the central opening 11 may be formed in a circular shape.

In addition, the bracket 10 may include a rectangular plate. In addition, the bracket 10 may include an insertion hole 12 to guide the coupling with the fixing body 30 in a vertical direction (or a shaft direction). The insertion hole 12 may be formed such that a coupling shaft 31 of the fixing body 30 to be described later is inserted into and/or fixed to the insertion hole 12.

A number of insertion holes 12 formed may correspond to a number of coupling shafts 31.

Further, the bracket 10 may include connection plates 13 extending vertically downward from opposite edges of the bracket 10. Therefore, the bracket 10 may be opened in the front-rear direction. The connection plates 13 may be positioned on opposite sides of the bracket 10. For example, the bracket 10 may be formed in the shape of tongs.

The connection plate 13 may be formed at opposite sides thereof with boss holes 15 configured to guide the coupling to the fixing body 30. The boss holes 15 may be formed such that coupling bosses 33 to be described later are inserted into and fixed to the boss holes 15. A number of boss holes 15 formed may correspond to a number of coupling bosses 33.

The connection plate 13 may include a connection guide 14 to guide the connection with external components.

The connection guide 14 may be formed to extend downward from the central portion of the connection plate 13. The connection guide 14 may be formed to be bent along the extending direction.

In addition, the bracket 10 may include a support plate 18 extending inward of the bracket 10 from the connection plate 13.

The support plate 18 may be formed to extend toward the center of the bracket 10 from a lower end portion of the connection plate 13. In other words, the support plate 18 may be inclined while extending toward the center of the bracket 10 from a lower end portion of the connection plate 13. The details thereof will be described below.

The rotary switch 1 may further include a cover 20.

The cover 20 may be positioned under the bracket 10. The cover 20 may be positioned to be inserted into or to pass through the central opening 11 of the bracket 10.

The cover 20 may include a shaft guide 21 to guide a shaft 105 of the rotating body 100.

The shaft guide 21 may be formed at the center of the cover 20. The shaft guide 21 may extend to pass through the central opening 11. For example, the shaft guide 21 may be provided in the form of a pipe extending upward.

The shaft guide 21 may be open in a vertical direction (or in a shaft direction) such that the shaft 105 may be inserted into and pass through the shaft guide 21. For example, the shaft guide 21 may be formed in a cylindrical shape to open the center of the cover 20 in the vertical direction.

The cover 20 may include coupling holes 22 formed in positions corresponding to the insertion holes 12 under the insertion holes 12 such that the coupling shafts 31 of the fixing body 30 may pass through the coupling holes 22. Similarly, a number of coupling holes 22 formed may correspond to a number of coupling shafts 31.

In other words, the coupling shafts 31 may be sequentially inserted into and pass through the coupling holes 22 and the insertion holes 12, thereby stably fixing the fixing body 30, the cover 20 and the bracket 10.

The rotary switch 1 may further include the rotating body 100 which may be rotatable.

The rotating body 100 may be positioned under the cover 20. In addition, the rotating body 100 may be positioned in such a manner that the rotating body 100 passes through the center of the cover 20 from the lower portion of the cover 20.

In this case, the lower portion of the cover 20 may be defined as including a position making contact with a bottom surface of the cover 20 and a position spaced apart downward from the bottom surface of the cover 20.

An elastic ring 200 to be described, the rotating body 100, and a leaf spring 60 may be positioned under the cover 20.

The rotating body 100 may include a shaft 105 extending upward.

The shaft 105 may extend in the longitudinal direction. For example, the shaft 105 may include a cylinder shape extending upward in the longitudinal direction.

The shaft 105 may form a central axis of the rotary switch 1. The shaft 105 may extend to pass through the shaft guide 21 of the cover 20 and the central opening 11 of the bracket 10.

A knob connection groove 108, which is recessed downward, may be formed in the top surface of the shaft 105. The knob connection groove 108 may guide the handing unit (not illustrated) such that the handling unit is coupled to the knob connection groove 108.

Accordingly, when the user rotates the handling unit, the rotating body 100 may receive the rotational force (torque) by the knob connection groove 108. Therefore, as a user rotates the handling unit, the rotating body 100 may be rotated, thereby controlling the above-described switch on-off.

The rotating body 100 may include protrusions 130 and 140 protruding in the radial direction and the shaft direction of the rotating body 100, respectively. The details of the rotating body 100 will be described below in detail.

The rotary switch 1 may further include the elastic ring 200.

The elastic ring 200 may be positioned under the cover 20. The elastic ring 200 may form a circular opening 205

(see FIG. 10) at the center thereof so that the shaft 105 passes through the circular opening 205.

The elastic ring 200 may include a ring shape.

The elastic ring 200 may be coupled to the bottom surface of the cover 20 to press the rotating body 100 downward. In other words, the elastic ring 200 may be interposed between the cover 20 and the protrusion of the rotating body 100.

The elastic ring 200 may make contact with the protrusion formed on the rotating body 100 to provide elastic force.

The elastic ring 200 may include an elastic protrusion 215 making contact with the protrusion of the rotating body 100. The elastic protrusion 215 may provide force toward the center axis of the rotating body 100.

The rotary switch 1 may further include a contact plate 50. The contact plate 50 may be positioned under the rotating body 100.

The contact plate 50 may be coupled to the rotating body 100. For example, the contact plate 50 may be coupled to the bottom surface of the rotating body 100. The contact plate 50 may be formed therein with a plurality of holes into which a plate fixing shaft (not shown) formed on the bottom surface of the rotating body 100 may be inserted. Accordingly, the contact plate 50 may be rotated together with the rotation of the rotating body 100 depending on the rotation of the rotating body 100.

Meanwhile, the bottom surface of the rotating body 100 may be understood as a bottom surface of the base 110 to be described later.

The contact plate 50 may be formed of a metal material.

In addition, the contact plate 50 may include a ring shape. The contact plate 50 may include a contact part extending in the circumferential direction and inclined downward so as to make contact with a switch pattern to be described later.

The rotary switch 1 may further include a fixing body 30 and a terminal 40.

The fixing body 30 may be positioned under the rotating body 100. In detail, the fixing body 30 may be positioned under the contact plate 50.

The fixing body 30 may be formed such that a portion of the shaft 105 may be received in the center thereof.

The fixing body 30 may include a hexahedron having an open top surface. The fixing body 30 may form an inner space in which the rotating body 100 may be received. For example, the inner space of the fixing body 30 may be provided in the shape of a circular groove.

The fixing body 30 may include the coupling boss 33 for coupling with the bracket 10.

The coupling boss 33 may be formed to protrude from opposite side surfaces of the fixing body 30. In addition, the coupling boss 33 may be formed in a shape and at a position that correspond to the boss hole 15 such that the coupling boss 33 may be inserted into and fixed to the boss hole 15.

The fixing body 30 may further include the coupling shaft 31 to guide the coupling of the cover 20 and the bracket 10.

The coupling shaft 31 may sequentially pass through the coupling hole 22 and the insertion hole 12. In detail, the coupling shaft 31 may extend upward from the upper end of the fixing body 30.

The coupling shaft 31 may have a cylindrical shape. For example, the coupling shaft 31 may be positioned near a corner along an upper edge of the fixing body 30. In this case, the coupling hole 22 and the insertion hole 12 may be positioned above corresponding to a position of the coupling shaft 31.

Accordingly, the coupling shaft 31 and the coupling boss 33 may stably fix and couple the bracket 10.

The fixing body 30 may further include a switch pattern with which the contact plate 50 makes contact while sliding. The switch pattern may be formed in the circumferential direction with respect to the central axis.

The switch pattern may be positioned on the bottom surface of the fixing body 30. The switch pattern may be connected to the terminal 40. Therefore, the contact plate 50, which rotates together with the rotation of the rotating body 100, may perform on-off control of the switch while making sliding contact with the switch pattern.

The terminal 40 may be coupled to the fixing body 30. For example, the terminal 40 may be inserted into the lower portion of the switch pattern.

The terminal 40 may include a plurality of connection terminals connected to a ground (GND), a power source, and the like. For example, the connection terminal may protrude from one side of the fixing body 30 and may be bent downward.

The rotary switch 1 may further include a leaf spring 60 and an auxiliary leaf spring 70.

The leaf spring 60 and the auxiliary leaf spring 70 may perform a function to generate a sound in accordance with the rotation of the rotating body 100 In other words, the leaf spring 60 and the auxiliary leaf spring 70 may generate a rotating sound.

The leaf spring 60 and the auxiliary leaf spring 70 may be formed of a metal material.

The leaf spring 60 may be received in the fixing body 30.

The leaf spring 60 may be positioned in a side direction of the rotating body 100. In addition, the leaf spring 60 may support the rotating body 100 in the side direction.

The leaf spring 60 may be positioned under the elastic ring 200. The upper end of the leaf spring 60 may contact the bottom surface of a front fixing part 230 (see FIG. 12) of the elastic ring 200.

The leaf spring 60 may include a plate shape. The leaf spring 60 may make rotational contact with the side protrusion 130.

Since the leaf spring 60 may apply elastic force to the side protrusion 130 formed in the side direction on the rotating body 100, a relatively fine torque may be applied to the rotating body 100 when the rotating body 100 rotates. Accordingly, the leaf spring 60 may guide the stable rotation of the rotating body 100.

The leaf spring 60 may include a central protrusion 65 protruding toward the rotating body 100. The central protrusion 65 may be formed to be engaged with the side protrusion 130 of the rotating body 100. For example, the central protrusion 65 may be formed such that a curved surface protrudes toward the rotating body 100 by bending the central portion of the leaf spring 60.

The central protrusion 65 may be elastically deformed or elastically restored as a plurality of side protrusions 130 formed in the circumferential direction of the rotating body 100 contact the central protrusion 65 while rotating.

The central protrusion 65 may contact a valley or a peak formed by the plurality of side protrusions 130 while sliding.

Meanwhile, the central protrusion 65 may be positioned to be inserted into the valleys formed by the plurality of side protrusions 130 before the elastic deformation starts or after the elastic restoration is completed. Accordingly, the central protrusion 65 may be formed in a shape corresponding to the shape of the valleys formed by the plurality of side protrusions 130.

The auxiliary leaf spring 70 may be positioned outside the leaf spring 60 with respect to the rotating body 100. The auxiliary leaf spring 70 may be received in the fixing body 30.

Hereinafter, the generation of rotation sound will be described in detail. The central protrusion 65 of the leaf spring 60 may elastically contact the rotation of the side protrusion 130 of the rotating body 100. Accordingly, the leaf spring 60 may generate a frictional sound or a colliding sound as the elastic deformation occurs.

In addition, in the process of elastically deforming the leaf spring 60, the auxiliary leaf spring 70 makes friction with opposite ends of the leaf spring 60 to generate a frictional sound. In the elastic restoring process of the leaf spring 60, the auxiliary leaf spring 70 may collide with the leaf spring 60 to generate a collision sound.

In addition, regarding the rotation sound, a rubbing sound or a colliding sound according to the contact of the elastic ring 200 and the upward protrusion 140 described later may be added.

Meanwhile, the upward protrusion 140 and the elastic ring 200 may improve the rotational operation feeling of the rotary switch 1 by providing torque to the rotating body 100. However, as described above, the upward protrusion 140 and the elastic ring 200 may generate a rotating sound.

Accordingly, as the rotating body 100 rotates, the elastic ring 200, the leaf spring 60, and the auxiliary leaf spring 70, which collide with or make friction with the rotating body 100, may provide light and clear rotation sound to the user that matches with the rotation of the rotating body 100.

Figure 3:
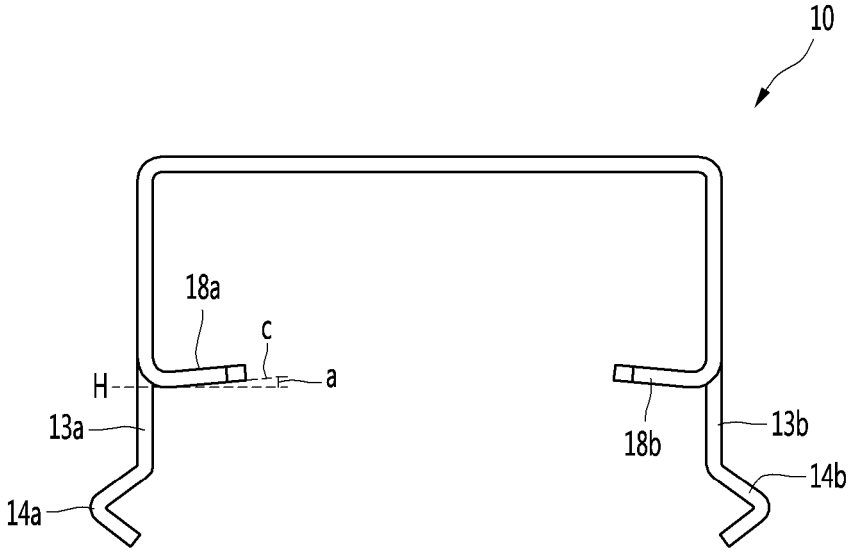
FIG. 3 is a front view illustrating a bracket according to an embodiment of the present disclosure.
Figure 4:
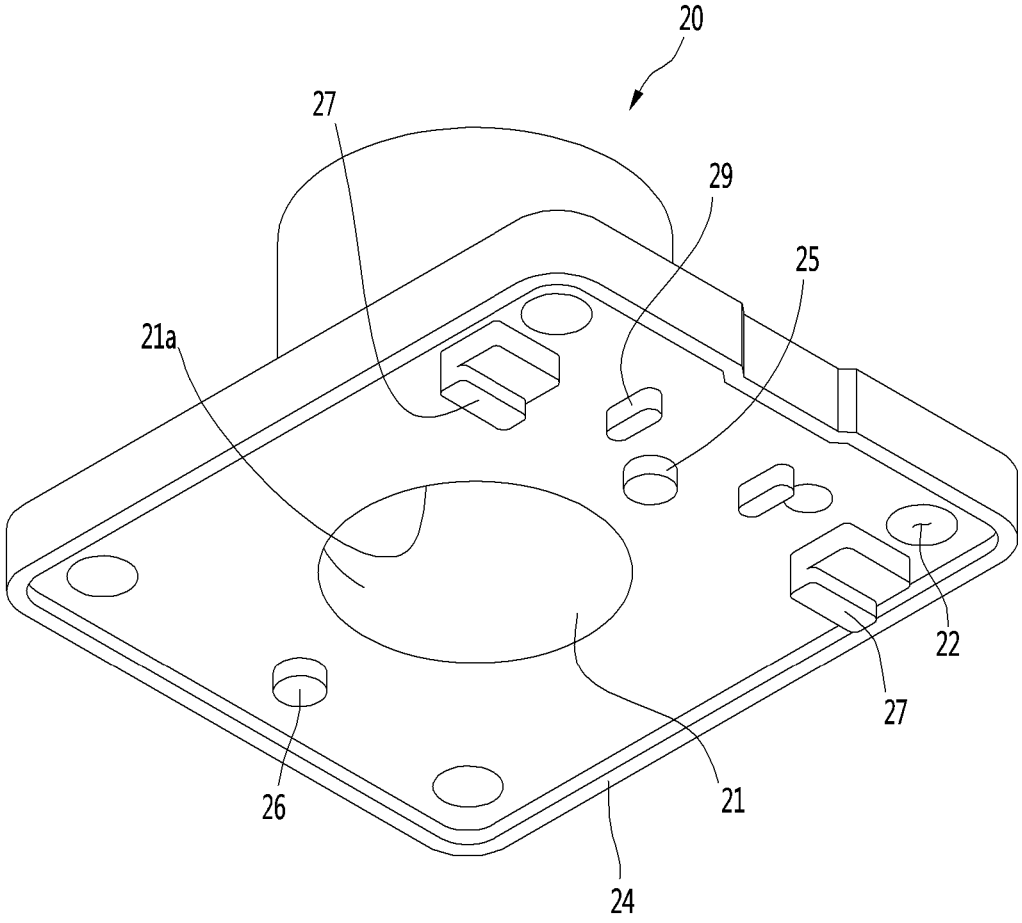
FIG. 4 is a bottom perspective view of a cover according to an embodiment of the present disclosure.
Figure 5:
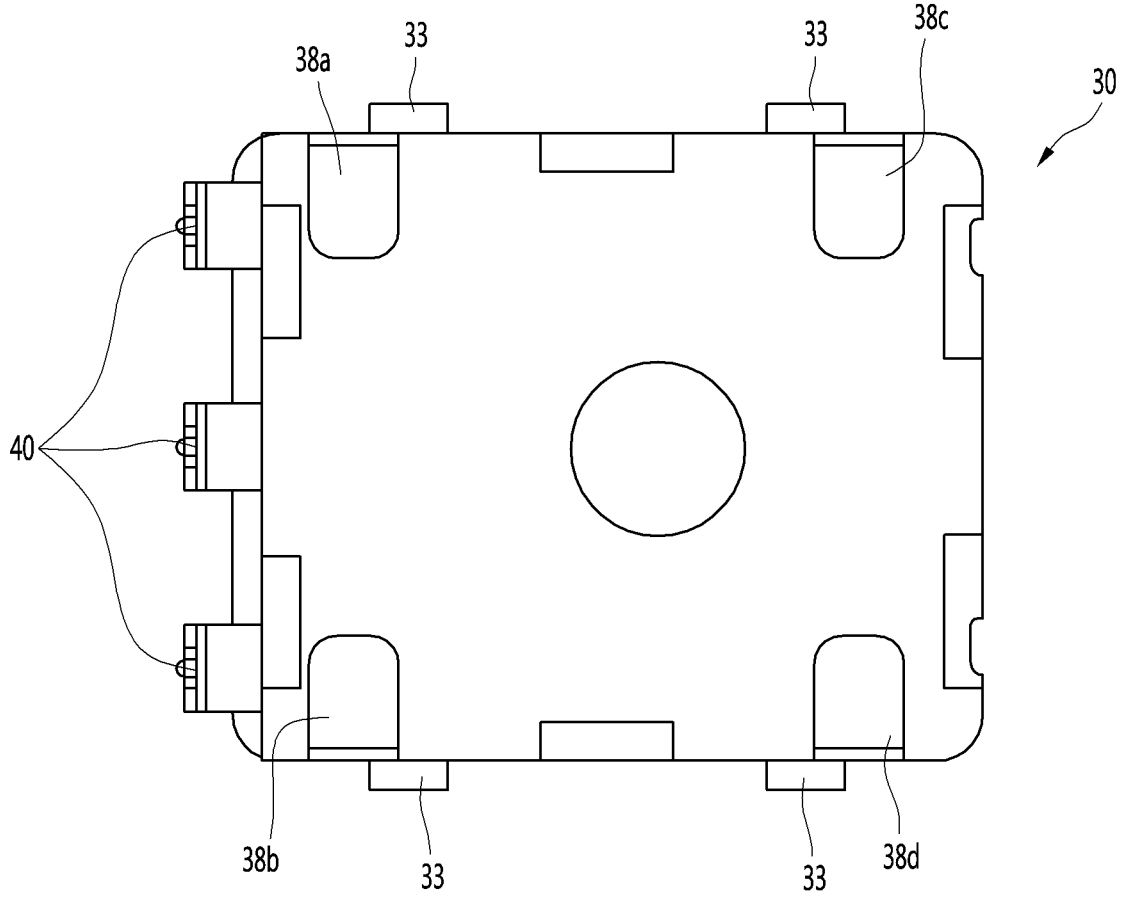
FIG. 5 is a front view of a fixing body according to an embodiment of the present disclosure.
Figure 6:
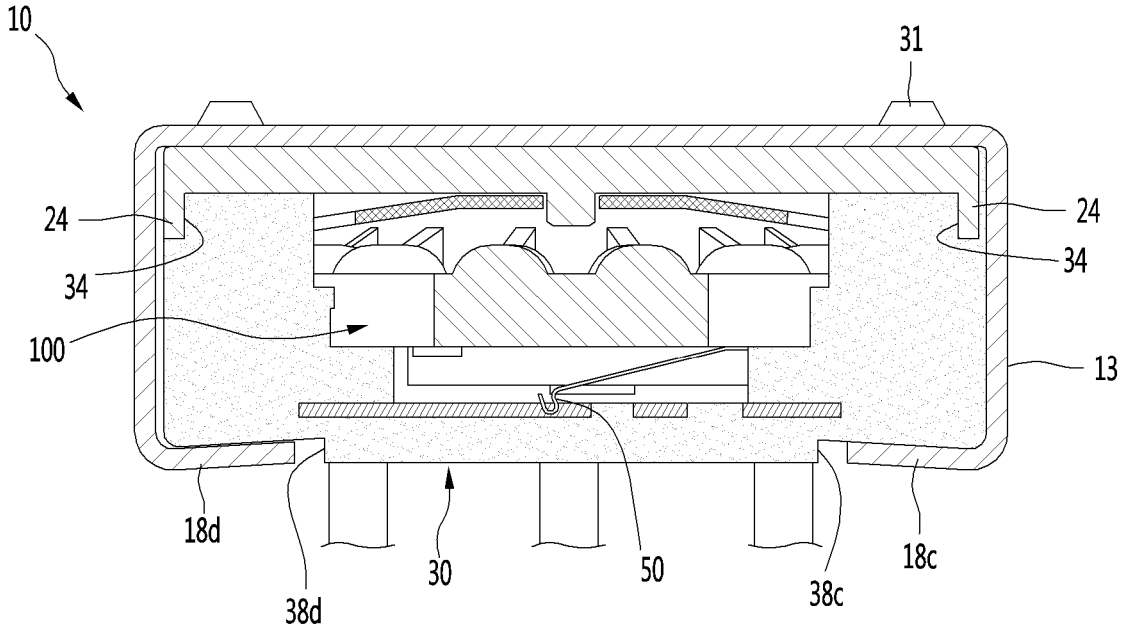
FIG. 6 is a sectional view taken along line I-I' of FIG. 1 according to an embodiment of the present disclosure.

FIG. 3 is a front view illustrating a bracket according to an embodiment of the present disclosure, FIG. 4 is a bottom perspective view of a cover according to an embodiment of the present disclosure, FIG. 5 is a front view of a fixing body according to an embodiment of the present disclosure, and FIG. 6 is a sectional view taken along line I-I' of FIG. 1.

Referring to FIGS. 2 to 6, the bracket 10 may include a support plate 18 inclined and extending from the connection plate 13.

A plurality of support plates 18 may be provided. For example, the support plate 18 may include a first support plate 18*a* and a third support plate 18*c* that are bent from a connection plate 13*a*, which forms one side surface of the bracket 10. The support plate 18 may also include a second support plate 18*b* and a fourth support plate 18*d* that are bent from a connection plate 13*b*, which forms the opposite side surface of the bracket 10.

The connection plate 13 forming one side surface of the bracket 10 may be called a first connection plate 13*a* and the connection plate 13 facing the first connection plate 13*a* may be called a second connection plate 13*a*. Similarly, the connection guide 14 formed on the first connection plate 13*a* may be called a first connection guide 14*a*, and the connection guide 14 formed on the second connection plate 13*b* may be called a second connection guide 14*b*.

The first support plate 18*a* and the third support plate 18*c* may be positioned facing the second support plate 18*b* and the fourth support plate 18*d*, respectively. In other words, the first support plate 18*a* and the third support plate 18*c* may be symmetrical with the second support plate 18*b* and the fourth support plate 18*d*.

The support plate 18 may be inclined toward the center of the bracket 10. In other words, the support plate 18 may be inclined and extend upward from the connection plate 13.

In more detail, the support plate 18 may extend along a virtual extension line "c" drawn upward at a predetermined angle "a" from a virtual horizontal line "H" drawn from a lower end portion of the connection plate 13. Accordingly, the support plate 18 may form the predetermined angle "a" with the virtual horizontal line "H".

In this case, the predetermined angle "a" may be an acute angle.

Since the above-described support plate 18 that is bent to be inclined upward may couple and/or support the fixing body 30 to the upper portion, an influence exerted on the fixing body 30, the cover 20, and the bracket 10 by the rotation of the rotating body 100 may be minimized. Accordingly, the deformation caused by the drawing force in an outward direction, the shaking due to the rotation, or the clearance resulting from the repeated rotation may be minimized.

Meanwhile, the cover 20 may further include a front guide shaft 25 and a rear guide shaft 26 for coupling the elastic ring 200.

The front guide shaft 25 may protrude downward from the bottom surface of the cover 20. The rear guide shaft 26 may be symmetrical to the center of the shaft guide 21.

The front guide shaft 25 and the rear guide shaft 26 may be inserted into guide holes of the elastic ring 200, which may correspond to the front guide shaft 25 and the rear guide shaft 26, respectively, in the front-rear direction. Accordingly, the elastic ring 200 may be fixed the front guide shaft 25 and the rear guide shaft 26.

In addition, the cover 20 may further include a fixing protrusion 29 to fix and support the position of the elastic ring 200.

The fixing protrusion 29 may be formed to make close contact with opposite end portions of front fixing parts 230 (see FIG. 10) of the elastic ring 200. For example, a pair of fixing protrusions 28 may be formed to protrude from the bottom surface of the cover 20. Further, the front guide shaft 25 may be interposed between the pair of fixing protrusions 28.

The cover 20 may further include a mounting protrusion 27 to be mounted to a right position of the fixing body 30 and coupled with the fixing body 30.

The mounting protrusion 27 may protrude from the bottom surface of the cover 20 to be inserted into the inner space of the fixing body 30. For example, a pair of mounting protrusions 27 may be formed. In addition, the mounting protrusions 27 may be positioned outside of the fixing protrusion 29.

In addition, the cover 20 may further include a seating end portion 21*a* positioned at a lower end portion of the shaft guide 21.

The seating end portion may contact a shaft stopper 120 of the rotating body 100. In other words, the seating end portion 21*a* may be seated on the shaft stopper 120.

Accordingly, when the drawing force outward is applied in an external direction or force is applied in the shaft direction, the seating end portion 21*a* may contact the shaft stopper 120 to maintain the space between the bottom surface of the cover 20 and the protrusion of the rotating body 100. In other words, the seating end portion 21*a* and the shaft stopper 120 may preserve the space in which the elastic ring 200 is installed. Accordingly, the elastic ring 200 may be prevented from being deformed or broken.

In addition, the cover 20 may further include an outer wall 24 extending vertically downward along the outer rim of the cover 20.

The outer wall 24 may include a step formed along the rim of the bottom surface of the cover 20. In addition, the outer wall 24 may be coupled to an upper end portion of the fixing body 30 to make close contact with the upper end portion of the fixing body 30.

Meanwhile, the fixing body 30 may further include an inner wall 34 having a step formed inward along an upper end portion of the fixing body 30.

The inner wall 34 may extend upward to be stepped from the upper end of the fixing body 30. The inner wall 34 may be formed in a shape corresponding to the outer wall 24.

The cover 20 may cover the open top surface of the fixing body 30 such that the outer wall 24 is in close contact with the outside of the inner wall 34.

In addition, the fixing body 30 may further include a support groove 38 into which the support plate 18 is inserted.

The support groove 38 may be formed on the bottom surface of the fixing body 30. The support groove 38 may be formed at a position corresponding to the support plate 18. For example, the support groove 38 may be recessed and inclined upward at a predetermined angle "a" from the lower end portion of the fixing body 30 by the predetermined angle "a".

In addition, the number of support grooves 38 formed may correspond to the number of the support plates 18. For example, the support grooves 38 may include a first support groove 38*a*, into which the first support plate 18*a* is inserted, a second support groove 38*b* in which the second support plate 18*b* is inserted, a third support groove 38*c* into which the third support plate 18*c* is inserted, and a fourth support groove 38*d* in which the fourth support plate 18*d* is inserted.

The bracket 10, the cover 20, and the fixing body 30 may be stably maintained airtight and sealed through the configuration of the bracket 10, the cover 20, and the fixing body 30. Therefore, a urethane coating liquid may be prevented from being infiltrated.

Figure 7:
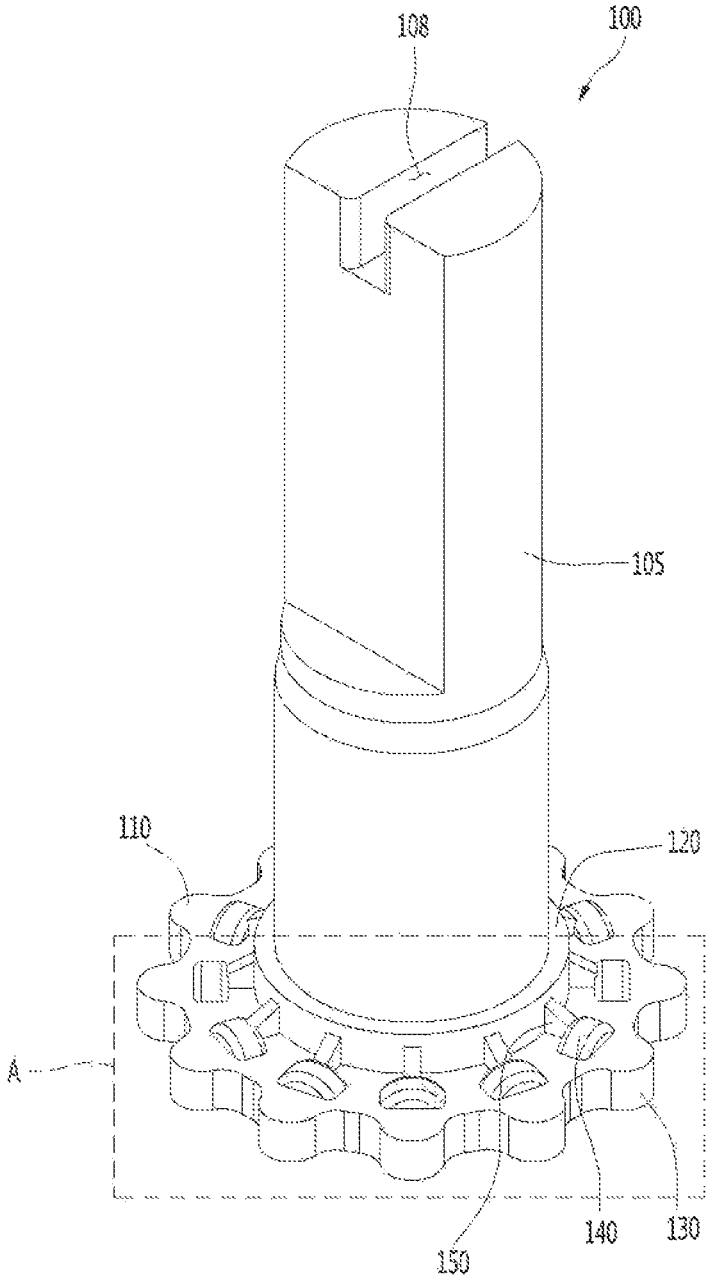
FIG. 7 is a perspective view of a rotating body according to an embodiment of the present disclosure.
Figure 8:
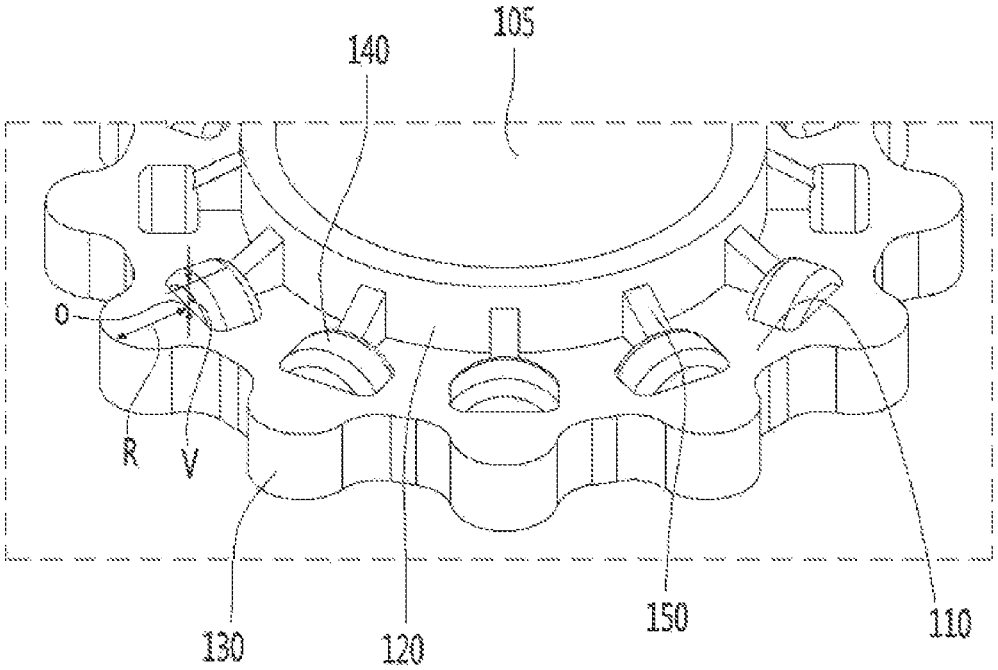
FIG. 8 is an enlarged view of part A of FIG. 7 according to an embodiment of the present disclosure.
Figure 9:
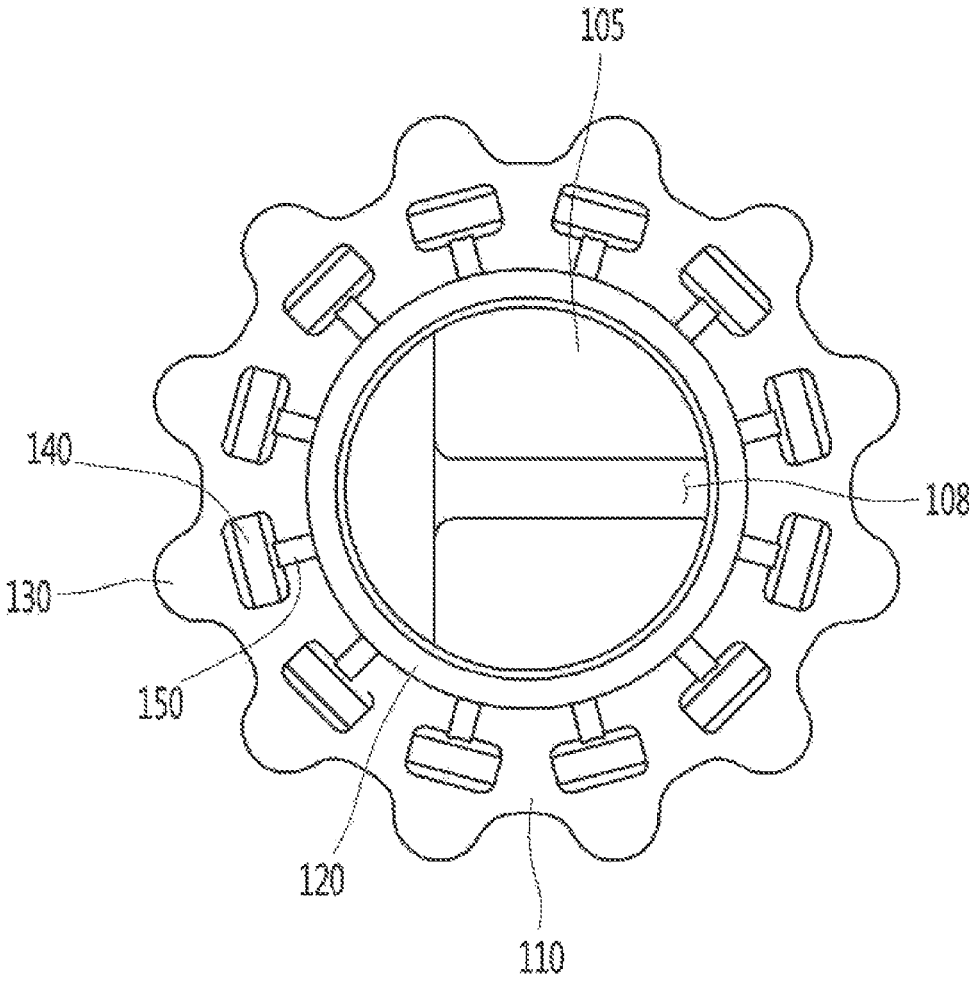
FIG. 9 is a top view of a rotating body when viewed from the top according to an embodiment of the present disclosure.

FIG. 7 is a perspective view of the rotating body according to an embodiment of the present disclosure, FIG. 8 is an enlarged view of part A of FIG. 7, and FIG. 9 is a top view of the rotating body when viewed from the top according to an embodiment of the present disclosure.

Referring to FIGS. 7 to 9, the rotating body 100 may include a base 110 coupled to the contact plate 50 and a shaft 105 extending upward from the center of the base 110.

The base 110 may have a disc shape. The contact plate 50 may be coupled to the bottom surface of the base 110. As the rotating body 100 rotates, the contact plate 50 may rotate in the inner space of the fixing body 30.

The rotating body 100 may be connected to a handling unit or handling device, which may allow a user to handle the rotation. For example, as described above, the knob connection groove 108 recessed in the top surface of the shaft 105 may be coupled to the handling unit to transfer the torque provided by the user to the rotating body 100.

The rotating body 100 may further include a shaft stopper 120 extending along a circumferential surface of the shaft 105 by a predetermined length.

In other words, the shaft stopper 120 may protrude in the radial direction from the lower outer circumferential surface of the shaft 105 and extend in the circumferential direction. For example, the shaft stopper 120 may be formed to extend in the radial direction from the shaft 105 by a predetermined length.

That is, the shaft stopper 120 may form a step difference from the lower portion of the shaft 105.

In another aspect, the shaft stopper 120 may extend upwardly from the base 110 to have a diameter greater than the diameter of the shaft 105. In this case, the shaft stopper 120 may have a cylindrical shape with a short length.

The shaft stopper 120 may extend from the base 110 to a position higher than the elastic ring 200. Accordingly, when drawing force or force is applied to the rotating body 100 in an outward direction or in a shaft direction, since the step difference of the shaft stopper 120 makes contact with the seating step part 21*a*, the elastic ring 200 may be prevented from being deformed and/or broken.

In addition, the rotating body 100 may further include protrusions 130 and 140 protruding in the shaft direction and the radial direction, respectively.

In other words, a plurality of protrusions 130 and 140 is provided on the top surface and the circumferential surface (or the side surface) of the base 110 in the circumferential direction, thereby forming a roughness shape.

Differently, the rotating body 100 may include protrusions 130 and 140 protruding in two directions perpendicular to each other.

The protrusions 130 and 140 may contact the elastic ring 200 or the leaf spring 60 while rotating. When the rotating body 100 is rotated, the elastic ring 200 may provide elastic force to the protrusions 130 and 140 in the shaft direction, and the leaf spring 60 may provide the elastic force to the protrusions 130 and 140 in the side direction.

The protrusions 130 and 140 may include a side protrusion 130 protruding in a radial direction along the circumferential surface of the base 110 and an upward protrusion 140 protruding in a direction perpendicular to the side protrusion 130.

In other words, the side protrusion 130 and the upward protrusion 140 may protrude from the base 110 in two different directions. For example, the side protrusion 130 and the upward protrusion 140 may extend in the side direction and the shaft direction of the base 110 to be perpendicular to each other from a common center O.

In addition, the side protrusion 130 and the upward protrusion 140 may extend in the side direction and the upward direction from the same position and may be provided in the circumferential direction of the base 110.

In other words, the side protrusion 130 and the upward protrusion 140 may be formed perpendicular to each other such that a starting point and an end point protruding from the base 110 are the same. In other words, the side protrusion 130 and the upward protrusion 140 may not be provided alternately.

Accordingly, since the rotation sound is generated in accordance with the rotation handling of the user, the rotating state may be acoustically informed to the user.

In addition, a plurality of side protrusions 130 and upward protrusions 140 may be formed in the circumferential surface of the base 100.

The side protrusion 130 may protrude in the side direction (or radial direction) from the circumferential surface of the base 100. The side protrusion 130 may have a surface which may be gently curved and faces the outside. The top surface and the lower surface of the side protrusion 130 may be formed as planes aligned in line with the base 110.

The upward protrusion 140 may be formed to protrude upward from the top surface of the base 110. The top surface of the upward protrusion 140 may have a surface which may be gently curved.

In addition, opposite side surfaces of the upward protrusion 140 may be formed as curved surfaces to improve the stiffness and the precision of the position.

As described above, the side protrusion 130 and the upward protrusion 140 may be referred to as protrusions of the rotating body 100.

The protrusions 130 and 140 of the rotating body 100 may have surfaces gently curved in the protrusion direction to make stable and smooth rotational contact with the leaf spring 60 or the elastic ring 200 For example, the side protrusion 130 and the upward protrusion 140 may have a semicircular cross section.

Meanwhile, the side protrusion 130 and the upward protrusion 140 may have different slopes due to the difference in the design value (for example, durability) between the elastic ring 200 and the leaf spring 60.

The side protrusion 130 may be formed to have a steeper slope at a point of first contact with the leaf spring 60, so as to generate a rhythmical. To the contrary, the upward protrusion 140 may be formed to have a gentler slope at a point first contact with the elastic ring 200 to provide smooth rotational operation feeling.

To make a smooth rotational contact with the elastic ring 200, the upward protrusion 140 may have a curved surface protruding from the base 110 that has a smaller slope than the curved surface of the side protrusion 130.

The protruded curved surface of the upward protrusion 140 may be understood as a top surface of the upward protrusion 140 and the protruded curved surface of the side protrusion 130 may be understood as an outer surface of the side protrusion 130. Therefore, the top surface of the upward protrusion 140 may be formed more gently than the outer surface of the side protrusion 130.

More specifically, with respect to the common midpoint O between the side protrusion 130 and the upward protrusion 140, the distance V from a common midpoint "0" to the uppermost point of the upward protrusion 140 may be greater than the distance "R" between the common midpoint "0" and the outermost point of the side protrusion 130.

In other words, the maximum length V of the upward protrusion 140 extending upward from the base 110 may be shorter than the maximum length R of the side protrusion 130 extending in the radial direction from the base 110. That is, the maximum extension length "V" of the upward protrusion may be shorter than the maximum extension length "R" of the side protrusion.

According to another embodiment, the radius of the longitudinal sectional surface of the upward protrusion 140 may be smaller than the radius of the cross sectional surface of the side protrusion 130.

In another embodiment, the longitudinal surface of the upward protrusion 140 may have an oval shape having a smaller radius toward the uppermost point. In addition, the cross-sectional surface of the side protrusion may have an oval shape having a radius increased toward the outermost point Accordingly, since the elastic ring 200 smoothly slides to the top surface, which is gentle and low, of the upward protrusion 140 while rotating and contacting the upward protrusion 140, the rotational operation of the handling unit felt by the user may be improved.

Since the leaf spring 60 makes friction or collides with a greater deformation degree due to a higher slope or height while rotating and contacting the side protrusion 130, the leaf spring 60 may generate a loud and rhythmical sound.

In addition, the rotating body 100 may further include an extending rib 150 provided at a lower portion of the rotating body 100 while extending in the radial direction.

The extending ribs 150 may extend in the radial direction from the outer circumferential surface of the shaft 105. In detail, the extending ribs 150 may extend in the radial direction from the outer circumferential surface of the shaft stopper 120.

In addition, the extending rib 150 may extend from the shaft stopper 120 to the upward protrusion 140. For example, the extending rib 150 may protrude in the radial direction from the circumferential surface (or side surface) of the shaft stopper 120 and may extend to the side surface of the upward protrusion 140.

Further, the extending rib 150 may be formed to have a height which may decrease in the radial direction. In other words, the extending rib 150 may be formed to have a height that decreases from the shaft stopper 120 to the upward protrusion 140. In other words, the top surface of the extending rib 150 may be inclined.

Further, the number of extending ribs 150 formed may correspond to the number of upward protrusions 140.

The extending rib 150 may reinforce the stiffness of the upward protrusion 140. The extending rib 150 may perform a guide to make contact between the elastic ring 200 and the upward protrusion 140 at a right position.

The elastic ring 200 may contact the upward protrusion 140 at a wrong position by deviating from the right position due to the repetitive rotation of the rotating body 100. As the case is repeated, the elastic ring 200 and the rotating body 100 may be abraded or cracked.

However, the extending rib 150 may prevent the elastic ring 200 from deviating from the right position due to the rotation of the elastic ring 200.

Figure 10:
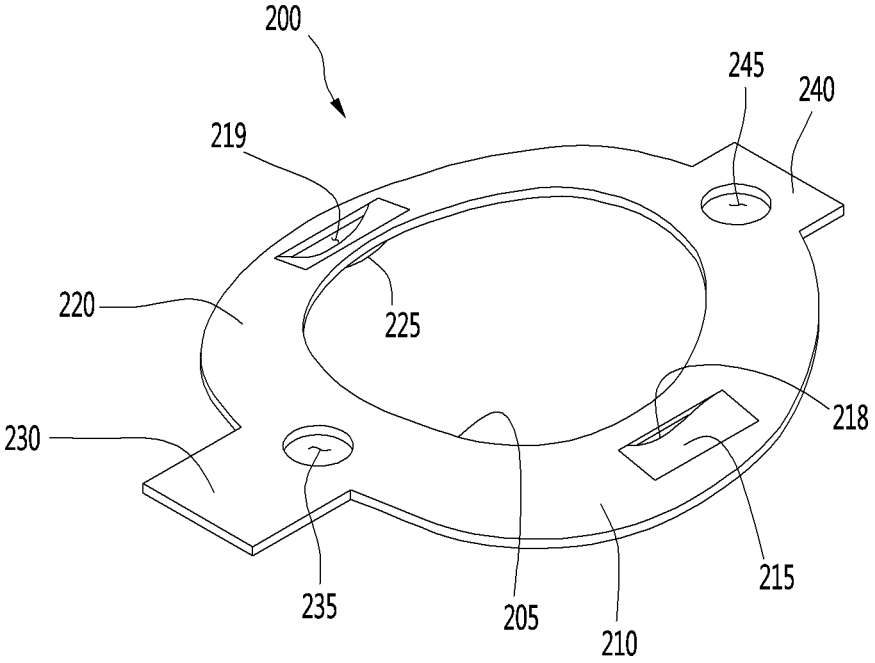
FIG. 10 is a perspective view illustrating an elastic ring according to an embodiment of the present disclosure.
Figure 11:
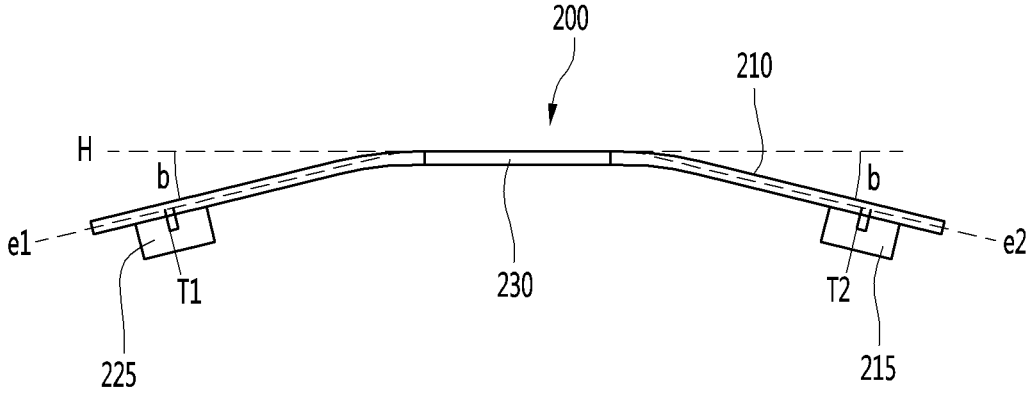
FIG. 11 is a front view of the elastic ring of FIG. 10 according to an embodiment of the present disclosure.

FIG. 10 is a perspective view illustrating an elastic ring according to an embodiment of the present disclosure, and FIG. 11 is a front view of the elastic ring according to an embodiment of the present disclosure.

Referring to FIGS. 10 and 11, the elastic ring 200 may be formed to have a tapered shape.

In detail, the elastic ring 200 may include a first bending part 210 bent downward from one side thereof and a second bending part 220 bent downward from an opposite side thereof.

The first bending part 210 and the second bending part 220 may be symmetrical to each other. For example, when the first bending part 210 forms a semicircle of the elastic ring 200, the second bending part 220 may form a remaining semicircle of the elastic ring 200.

Since the first bending part 210 and the second bending part 220 are bent from the central portion of the elastic ring 200 downward on opposite sides thereof, force may be applied to the rotating body 100 in the central axis.

A virtual horizontal line "H" may be set for the convenience of explanation of the first bending part 210 and the second bending part 220. The virtual horizontal line "H" may be understood as a horizontal line extending in parallel to the extension plane of a front fixing part 230.

The first bending part 210 may be bent downward at a predetermined bending angle "b" from the virtual horizontal line "H". The bending angle "b" may include an acute angle.

Similarly, the second bending part 220 may be bent downward at a predetermined bending angle "b" from the virtual horizontal line.

Meanwhile, the elastic ring 220 may include elastic protrusions 215 and 225 contacting the protrusion of the upward protrusion 140.

The elastic protrusions 215 and 225 may protrude downward from the elastic ring 220. The protrusion portions of the elastic protrusions 215 and 225 may be rounded. Therefore, the bottom surfaces of the elastic protrusions 215 and 225 may have gently curved surfaces.

In addition, the elastic protrusions 215 and 225 may protrude downward from both of the bending portions 210 and 220 such that opposite sides of the elastic protrusions 215 and 225 are cut out.

The elastic protrusions 215 and 225 may include a first elastic protrusion 215 and a second elastic protrusion 225 that are symmetrical to each other.

The first elastic protrusion 215 and the second elastic protrusion 225 may be symmetrical to each other.

Accordingly, since the first elastic protrusion 215 and the second elastic protrusion 225 press the upward protrusion 140 at a point of 180°, a guide may be provided such that the rotation is more stably performed. In summary, the elastic ring 200 may press the rotating body 100 in at least two points symmetrical to each other.

The first elastic protrusion 215 may be formed to protrude downward T2 perpendicular to a virtual extension line e2 drawn in an extension direction of the first bending part 210 while forming the bending angle "b".

Similarly, the second elastic protrusion 225 may be formed to protrude downward T1 perpendicular to a virtual extension line e1 drawn in an extension direction of the second bending part 220 while forming the bending angle "b".

Accordingly, when the rotating body 100 is rotated through the rotation handling by a user, the elastic protrusions 215 and 225 may act as resultant force F of force FL pressing vertically downward against the upward protrusion 140 and force Fc pressing the upward protrusion 140 toward the center.

The first elastic protrusion 215 and the second elastic protrusion 225 may be formed to have widths smaller than the widths of the bending parts 210 and 220 extending in a circular shape.

Meanwhile, the elastic ring 200 may include elastic reinforcing holes 218 and 219 to reinforce the elastic force of the elastic protrusions 215 and 225.

The elastic reinforcing holes 218 and 219 may be defined as spaces spaced apart in the vertical direction between the bottom surface of the elastic ring 200 and the elastic protrusions 215 and 225.

In detail, a portion of a top surface of the first bending part 210 may be recessed downward such that the first elastic protrusion 215 protrudes downward in the vertical direction from the first bending part 210. In this case, the first elastic protrusion 215 may have openings 218 spaced apart bi-directionally from the first bending part 210.

The spaces, which are open bi-directionally between the first elastic protrusion 215 and the first bending part 210, may be named a first elastic enhancing hole 218.

Since the first elastic enhancing hole 218 forms a space opened downward from the first bending part 210, the first elastic protrusion 215 may be guided to be elastically deformed easily.

Similarly, the second elastic protrusion 225 may form the second elastic enhancing hole 219.

In summary, the elastic ring 200 may include elastic enhancing holes 218 and 219 provided at opposite sides of the elastic protrusions 215 and 225 and may include openings to create a space between the elastic protrusions 215 and 225 and the bending parts 210 and 220.

The elastic ring 200 may further include a front fixing part 230 and a rear fixing part 240 to be fixed to the cover 20 or the fixing body 30.

The front fixing part 230 and the rear fixing part 240 may be provided in the form of a rectangular flat plate.

The front fixing part 230 may include front end portion protruding and extending forward. The rear fixing part 240 may include a rear end portion protruding and extending rearward. In some embodiments, the rear fixing part 240 may be shorter than the front fixing part 230.

Opposite end portions of the front fixing part 230 may be fitted between the fixing protrusions 29 of the cover 20. The front end portion of the front fixing part 230 may be inserted or seated in the fixing body 30. Similarly, the rear end portion of the rear fixing part 240 may be inserted or seated in the fixing body 30.

In addition, the front fixing part 230 may include a front guide hole 235, into which the front guide shaft 25 may be inserted. The rear fixing part 240 may include a rear guide hole 245, into which the rear guide shaft 26 may be inserted.

Therefore, the elastic ring 200 may be stably supported by the cover 20 and the fixing body 30. Accordingly, the elastic ring 200 may stably press the upward protrusion 140 of the rotating body 100.

The front fixing part 230 and the rear fixing part 240 may be positioned at the center of the elastic ring 200. Therefore, the first bending part 210 and the second bending part 220 may be formed symmetrically to each other with respect to the fixing parts 230 and 240.

In addition, the front fixing part 230 and the rear fixing part 240 may provide references of front and rear positions of the elastic ring 200.

In other words, the front fixing part 230 and the rear fixing part 240 may guide the elastic ring 200 such that the elastic ring 200 may be mounted in a right position of the cover 20 or the fixing body 30.

Although the elastic ring 200 may provide elastic force to the protrusions 130 and 140 of the rotating body 100 together with the leaf spring 60, the elastic ring 200 may have a mechanical property different from that of the leaf spring 60. For example, the elastic ring 200 may be formed to have a greater elastic coefficient, stiffness, and durability than the leaf spring 60.

Accordingly, since the elastic ring 200 may provide the rotating body 100 with an elastic force in a range that is greater than the elastic force provided from the leaf spring 60 to the side protrusion 130, the elastic ring 200 may serve as the major cause of torque applied to the rotating body 100.

If the leaf spring 60 is designed to have a significantly low elastic coefficient compared to that of the elastic ring 200, even if the degree of deformation of the leaf spring 60 is relatively large, the influence of the overall elastic force exerted on the rotating body 100 may be made much smaller in leaf spring 60 than the elastic ring 200.

In other words, the leaf spring 60 may provide a relatively small unit of torque to the rotating body 100.

In other words, when manufacturing the rotary switch 1, allowable torque values may be set in 10 units or 100 units through the design of the elastic ring 200 and the upward protrusion 140. The allowable torque value may be set in one or less unit through the design of the leaf spring 60 and the side protrusion 130.

For example, assuming that a user may tactilely recognize the rotation operation and the allowable torque value is 312 (kgf·cm) allowing the optimal smooth rotation operation, the value of 300 or 310 may be set through the design of the elastic ring 200 and the upward protrusion 140, and the value of 12 or 2 may be set through the design of the leaf spring 60 and the side protrusion 130.

Meanwhile, as described above, when the leaf spring 60 is designed to have a larger degree of deformation, the frictional sound and the colliding sound may be formed relatively loud. Therefore, it can be understood that the main function of the elastic ring 200 may be to improve the rotational operation feeling, and it can be understood that the main function of the leaf spring 60 may be to improve the rotation sound.

Figure 12:
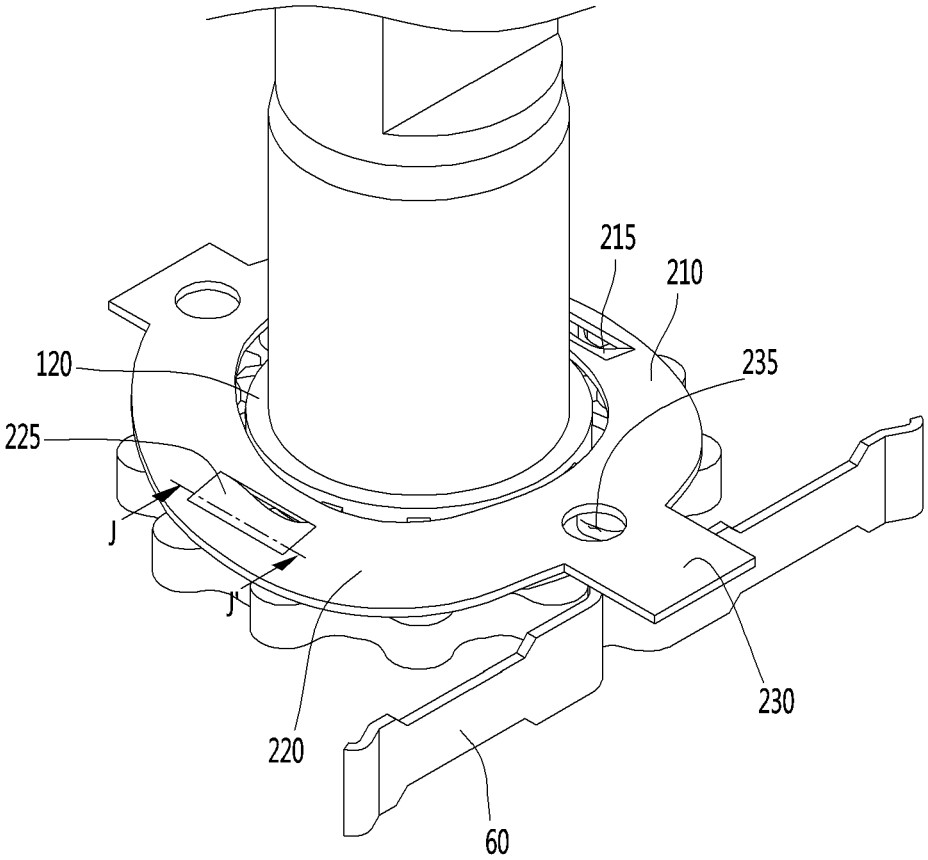
FIG. 12 is an assembled perspective view illustrating a coupling relationship between a rotating body, an elastic ring, and a leaf spring according to an embodiment of the present disclosure.
Figure 13:
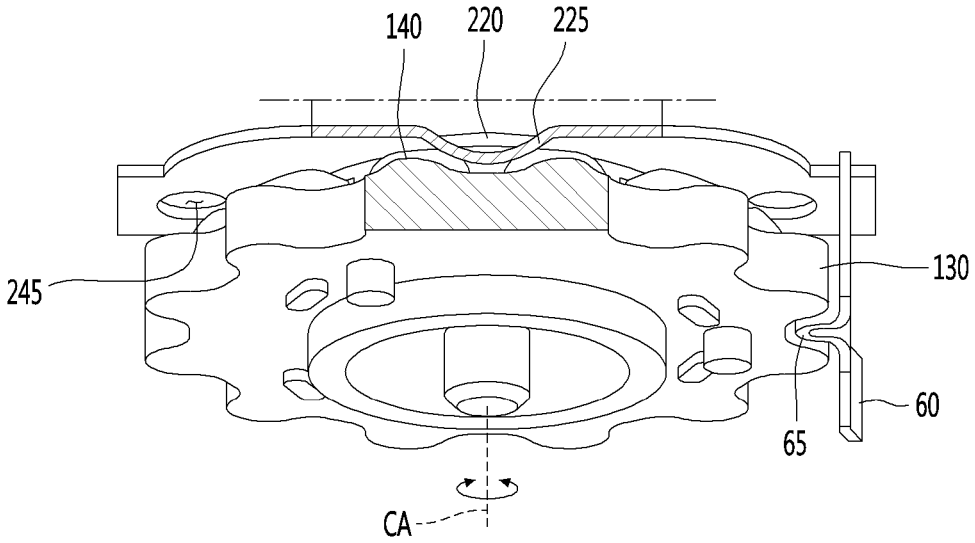
FIG. 13 is a sectional view taken along line J-J' of FIG. 12 according to an embodiment of the present disclosure.
Figure 14:
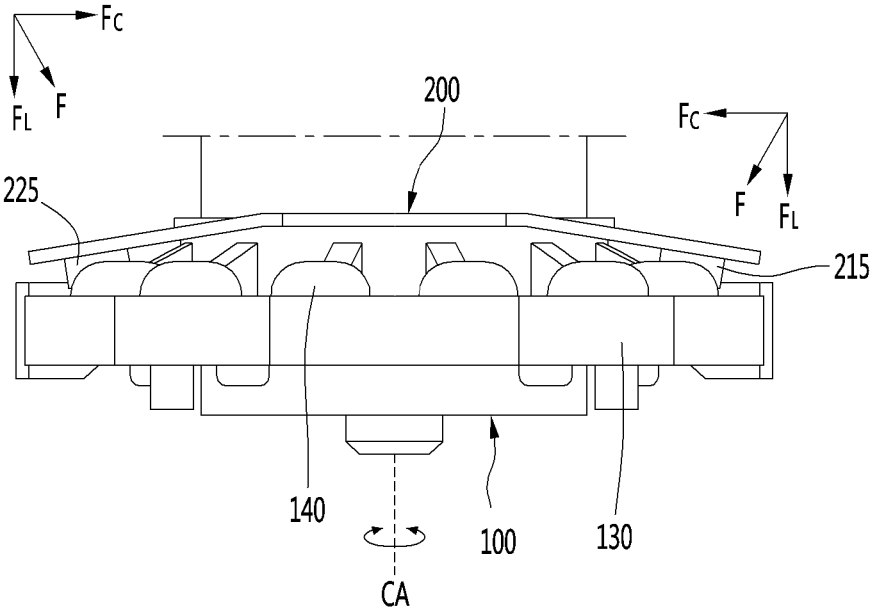
FIG. 14 is a front view of the coupling relationship of FIG. 12 according to an embodiment of the present disclosure.

FIG. 12 is an assembled perspective view illustrating a coupling relationship between the rotating body, the elastic ring, and the leaf spring according to an embodiment of the present disclosure, FIG. 13 is a sectional view taken along line J-J' of FIG. 12, and FIG. 14 is a front view of FIG. 12.

Referring to FIGS. 12 to 14, the protrusions 130 and 140 of the rotating body 100 may contact the elastic ring 200 and the leaf spring 60.

The elastic protrusions 215 and 225 may be elastically restored when the elastic protrusions 215 and 225 are positioned in the valleys formed by the plurality of the upward protrusions 140. In addition, the elastic protrusions 215 and 225 may be most elastically deformed when they are positioned on the ridges of the upward protrusions 140.

The central protrusion 65 may be elastically restored when the central protrusion 65 is positioned in the valleys formed by the plurality of side protrusions 130. The central protrusion 65 may be most elastically deformed when the central protrusion 65 is positioned on the ridge of the side protrusion 130.

As described above, when the rotating body 100 is rotated about the center axis CA as the user handles the rotation operation, the elastic protrusions 215 and 225 may act as resultant force F, including force FL pressing vertically downward against the upward protrusion 140 and force Fc pressing the upward protrusion 140 toward the center of the rotating body 100.

In other words, the elastic ring 200 may downward apply force to the rotating body 100 and toward the central axis CA. This action of applying the force F may enable the rotation of the rotating body 100 to be stably maintained with respect to the central axis CA. Therefore, it may be possible to reduce the shaking due to the rotation of the rotating body 100, and to minimize the deviation from the rotation radius, thereby improving the rotation stability.

In addition, since the elastic ring 200 may press the rotating body 100 vertically downward, the shaking and the vibration may be reduced, and the rotation stability may be improved relative to when a conventional rotating body is supported only in the transverse direction or side direction.

In addition, as the elastic ring 200 is provided to stably support the rotating body 100, the inner space of the fixing body 30 may be formed in a compact size. Accordingly, the space formed from the protrusions 130 and 140 of the rotating body 100 in the side direction and radial direction may be minimized. Accordingly, the clearance between components, which is caused by the repeated rotation, may be minimized Meanwhile, the elastic ring 200, the leaf spring 60, and the auxiliary leaf spring 70 may be included in the elastic body. Accordingly, the elastic ring 200 may be referred to as a first elastic unit. In addition, the leaf spring 60 may be referred to as a second elastic ring, and the auxiliary leaf spring 70 may be referred to as a third elastic ring.

What is claimed is:

1. A rotary switch, comprising:

a fixing body;

a rotating body comprising a first protrusion protruding in a vertical direction and a second protrusion protruding in a radial direction, wherein at least a portion of the rotating body is disposed in the fixing body;

a cover coupled to an upper portion of the fixing body, the cover being configured to allow the rotating body to pass through the cover;

a first elastic body disposed under the cover to contact the first protrusion; and a second elastic body disposed under the cover to contact the second protrusion, wherein the first protrusion and the second protrusion are formed to protrude in a direction perpendicular to each other at a common center.

2. The rotary switch of claim 1, wherein the first elastic body is configured to support the rotating body in the vertical direction, and wherein the second elastic body is configured to support the rotating body in a side direction.

3. The rotary switch of claim 1, wherein the first elastic body is ring-shaped such that the rotating body passes through a center of the first elastic body and provides force toward a center of the rotating body.

4. The rotary switch of claim 1, wherein the first elastic body comprises:

a first bending part and a second bending part, the first and second bending parts being bent downward symmetrically to each other.

5. The rotary switch of claim 4, wherein the first elastic body comprises:

a first elastic protrusion protruding downward from the first bending part; and a second elastic protrusion protruding downward from the second bending part.

6. The rotary switch of claim 5, wherein each of the first elastic protrusion and the second elastic protrusion has a rounded elastic portion.

7. The rotary switch of claim 5, wherein the first elastic body comprises elastic enhancement holes extending away from the first elastic protrusion and the second elastic protrusion in a vertical direction.

8. The rotary switch of claim 1, wherein the first elastic body is configured to press the rotating body in at least two points that are symmetrical to each other.

9. A rotary switch comprising:

a fixing body and a rotating body configured to control an on or off condition of the rotary switch through rotation, wherein the rotating body comprises:

a circular base;

a shaft extending upward from a center of the circular base;

a side protrusion protruding in a radial direction from the circular base such that a plurality of valleys and ridges are formed along a circumferential direction on a circumferential surface of the circular base; and an upward protrusion protruding in a direction perpendicular to a protruding direction of the side protrusion so as to correspond to the side protrusion, wherein the upward protrusion forms a plurality of valleys and ridges along a circumferential direction on an upper surface of the circular base.

10. The rotary switch of claim 9, wherein the upward protrusion protrudes at a slope from the circular base, wherein the slope is smaller than a slope of the side protrusion.

11. The rotary switch of claim 10, wherein a plurality of upward protrusions and a plurality of side protrusions are formed in a circumferential direction of the circular base.

12. The rotary switch of claim 9, wherein the upward protrusion comprises a maximum extension length shorter than a maximum extension length of the side protrusion.

13. The rotary switch of claim 9, wherein the rotary switch further comprises:

a first elastic body elastically in contact with the upward protrusion; and a second elastic body elastically in contact with the side protrusion.

14. The rotary switch of claim 13, wherein the rotating body further comprises:

a shaft stopper having a step along a lower circumference of the shaft.

15. The rotary switch of claim 14, wherein the shaft stopper extends from the circular base to a position higher than the first elastic body.

16. The rotary switch of claim 14, wherein the rotary switch further comprises:

a cover configured to cover a top surface of the fixing body, and wherein the cover comprises:

a shaft guide having an opening configured to allow the shaft to pass through the opening; and a guide shaft extending downward from a bottom surface of the cover and configured to fix the first elastic body.

17. The rotary switch of claim 16, wherein the shaft stopper is configured to contact a seating end portion positioned at a lower portion of the shaft guide.

18. The rotary switch of claim 9, wherein the rotating body further comprises:

an extending rib extending from the shaft toward the upward protrusion.

19. The rotary switch of claim 18, wherein a height of the extending rib decreases from the shaft toward the upward protrusion.

20. A rotary switch comprising:

a fixing body having a switch pattern;

a contact plate disposed in the fixing body and contacting the switch pattern;

a rotating body coupled to the contact plate;

a cover coupled to an upper portion of the fixing body such that the rotating body passes through a center of the cover;

a bracket coupled to an upper portion of the cover such that the rotating body passes through a center of the bracket;

an elastic ring coupled to a lower portion of the cover such that the rotating body passes through a center of the elastic ring; and a leaf spring disposed in the fixing body, wherein the rotating body comprises:

a first protrusion and a second protrusion protruding in two different directions from a common center, wherein the elastic ring is provided to contact the first protrusion in a direction opposite to a protruding direction of the first protrusion, and wherein the leaf spring is provided to contact the second protrusion in a direction opposite to a protruding direction of the second protrusion.

* * * * *